US006871638B2

(12) United States Patent
Kondo

(10) Patent No.: US 6,871,638 B2
(45) Date of Patent: Mar. 29, 2005

(54) HIGH PRESSURE FUEL ACCUMULATION DEVICE

(75) Inventor: Jun Kondo, Obu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/751,495

(22) Filed: Jan. 6, 2004

(65) Prior Publication Data

US 2004/0139945 A1 Jul. 22, 2004

(30) Foreign Application Priority Data

Jan. 7, 2003 (JP) ..... 2003-001342

(51) Int. Cl.[7] ..... F02M 41/00
(52) U.S. Cl. ..... 123/469; 123/468
(58) Field of Search ..... 123/468, 469, 123/470, 456; 285/133.11, 133.4, 261, 266

(56) References Cited

U.S. PATENT DOCUMENTS 4,893,601 A * 1/1990 Sugao ..... 123/468
5,775,302 A 7/1998 Guido et al.
5,957,507 A 9/1999 Asada
6,431,150 B1 * 8/2002 Pearlman et al. ..... 123/468
6,463,909 B2 * 10/2002 Asada et al. ..... 123/456
6,497,220 B1 * 12/2002 Boecking ..... 123/469

FOREIGN PATENT DOCUMENTS

JP P-3355699 10/2002

* cited by examiner

*Primary Examiner*—Carl S. Miller
(74) *Attorney, Agent, or Firm*—Nixon & Vanderhye P.C.

(57) ABSTRACT

A common rail has an accumulation pipe in which high pressure fuel is accumulated, a pipe joint to which a high pressure pipe is connected and an orifice member housed inside the pipe joint. The orifice member is provided with a conduit through which a fuel port formed in the accumulation pipe communicates with the high pressure pipe. The conduit is provided at an end thereof with an orifice. The orifice serves to reduce pressure pulsation generated by fuel injection of an injector so that fuel pressure in the common rail is stable. Since the orifice is formed in the orifice member housed in the pipe joint, the orifice is easily and accurately manufactured at a lower cost, compared to an orifice formed in the accumulation pipe. It is easy to standardize the manufacture of plural models of common rails whose orifice diameters are different.

5 Claims, 5 Drawing Sheets

HIGH PRESSURE FUEL ACCUMULATION DEVICE

CROSS REFERENCE TO RELATED APPLICATIONS

This application is based upon and claims the benefit of priority of Japanese Patent Application No. 2003-1342 filed on Jan. 7, 2003, the content of which is incorporated herein by reference.

BACKGROUND OF THE INVENTION

1. Field of the Invention

The present invention relates to a pipe joint structure of a high pressure fuel accumulation device applicable to an accumulation type fuel injection system.

2. Description of Related Art

Conventionally, an accumulation type fuel injection system is known, in which high pressure fuel is accumulated in an accumulation device so called a common rail and the high pressure fuel thus accumulated is injected from respective injectors to respective cylinders of a diesel engine. The conventional accumulation type fuel injection system has a drawback in that, since pressure of the fuel accumulated in the common rail is extremely high (for example, about 150 Mpa), if pressure pulsation occurs on injecting the fuel from one of the injectors, the pressure pulsation is likely to cause pressure variation in the common rail so that respective fuel injection amount and injection timing of the other injectors are fluctuated.

To cope with this drawback, for example, JP-P-3355699 discloses a prior art for reducing the pressure pulsation in such a manner that a throttle 120 (an orifice) is provided at a bottom of a pipe joint 110 formed in a common rail 100, as shown in FIG. 8.

According to a structure shown in FIG. 8, since the throttle 120 is positioned at a bottom of the pipe joint 110 to which a high pressure pipe 130 is connected, fabrication of the throttle 120 is a troublesome work and it is rather difficult to form the throttle 120 with accurate dimension, resulting in higher fabrication cost.

Further, since the throttle 120 is formed directly in a main body of the common rail 100, it is troublesome to mass-produce plural models of the common rails 100 in which respective models thereof have substantially uniform main bodies but have different diameters of the throttles. That is, it is very difficult to standardize fabrication of the common rail 100, resulting in higher manufacturing cost of the high pressure fuel accumulation device.

SUMMARY OF THE INVENTION

An object of the present invention is to provide a high pressure fuel accumulation device in which the throttle is easily formed at less manufacturing cost and separately from the main body thereof so that different diameter of the throttle is easily realized in use of the standardized main body.

To achieve the above object, in the high pressure fuel accumulation device, a main body is provided in an interior thereof with an accumulation chamber for accumulating high pressure fuel. A through-hole radially extending from the accumulation chamber is formed in a circumferential wall of the main body. The main body is further provided on an exterior circumferential wall thereof surrounding the through-hole and at a position substantially concentrical with the through-hole with a hollowed pipe joint to which the fuel distribution pipe is fastened. A cylindrical intermediate member is housed inside the hollowed pipe joint and sandwiched under pressure between an axial end of the fuel distribution pipe and the exterior circumferential wall of the main body around the through-hole. The cylindrical intermediate member has a conduit extending through an axial center thereof so that the fuel distribution pipe communicates with the through-hole via the conduit. The conduit is provided at a part thereof with an orifice whose inner diameter is smaller than that of any other part of the conduit and smaller than an inner diameter of the through-hole.

Since the orifice is formed in the intermediate member housed in the hollowed pipe joint, the orifice is easily and accurately manufactured at a lower cost, compared to an orifice formed in a conventional accumulation pipe.

Further, the inner diameter of the orifice is variable according to change of the intermediate member. That is, by preparing plural kinds of intermediate members each having different inner diameter of the orifice and changing the kind of intermediate member, plural models of high pressure accumulation device, in each model of which orifice diameter is different, can be easily manufactured.

The accumulation chamber is formed inside an accumulation pipe and the through-hole is formed in a circumferential wall of the accumulation pipe and, further, the hollowed pipe joint is formed separately from the accumulation pipe and bonded to an outer circumference of the accumulation pipe.

Since the accumulation pipe and the pipe joint are separately formed, the accumulation pipe is easily manufactured and, even if an installation position of the pipe joint is different in every engine, fabrication of the accumulation pipe and the pipe joint can be standardized, resulting in lower manufacturing cost.

It is preferable that the circumferential wall of the main body is provided along an axial end circumference of the through-hole on a side opposite to the accumulation chamber with a conical seat surface, and the cylindrical intermediate member is provided at an end thereof on a side of an axial end of the conduit with a semi-sphere shaped seat, whereby the semi-sphere shaped seat is pressed against the conical seat surface.

With the structure mentioned above, when the intermediate member is housed inside the pipe joint, even if the intermediate member is inserted into the pipe joint in a state that an axis of the intermediate member is off set from or inclined to an axis of the through-hole, the semi-sphere shape of the intermediate member causes the off set or inclination to be automatically adjusted or causes the seat of the intermediate member to come in fluid-tight contact with an entire circumference of the seat surface, which results in securing reliable sealing. In particular, in case that the accumulation pipe and the pipe joint are separately formed and, then, bonded to each other, an advantage of the semi-sphere shape of the intermediate member is larger since an axis of the pipe joint is sometimes shifted slightly from the axis of the through-hole.

Further, it is preferable that the orifice is formed at an axial end of the conduit so that inner diameter of the conduit extending from the orifice toward the other axial end thereof is larger than that of the orifice.

It is not necessary to form the orifice covering an entire axial length of the conduit and it is sufficient that length of the orifice provided at the axial end of the conduit is relatively short so that manufacture of the orifice is easy since the orifice is fabricated from an axial end of the intermediate member.

Further, the main body has plural pieces of the through-holes formed in the circumferential wall thereof at a given longitudinal spacing. Each of the through-holes serves as a fuel outlet of the main body to be connected with each injector via the fuel delivery pipe.

With this construction, the orifice provided in the intermediate member serves to reduce pressure pulsation generated by fuel injection of an injector and fuel pressure in the accumulation chamber is stable, resulting in less fluctuation of injection amount and injection timing of the other injector.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Embodiments of the present invention is described with reference to drawings.

(First Embodiment)

A high pressure fuel accumulation device according to a first embodiment, which is applied to a accumulation type fuel injection system for 4 cylinder diesel engine, is described with FIGS. 1 to 5.

Figure 3:
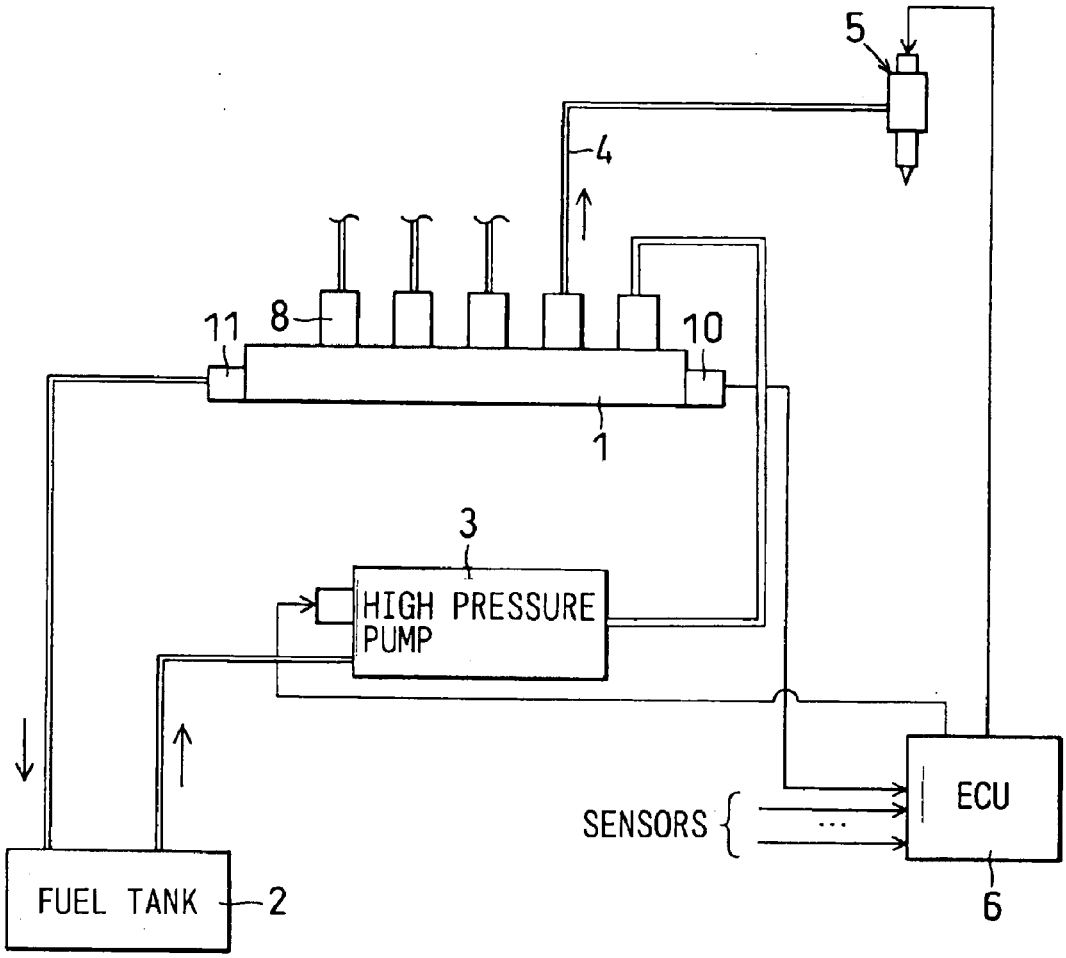
FIG. 3 is a schematic view of an entire structure of an accumulation type fuel injection system to which the high pressure fuel accumulation device of FIG. 1 is applied.

As shown in FIG. 3, the accumulation type fuel injection system has a common rail 1, a high pressure pump 3 for sucking fuel from a fuel tank 2, pressurizing and discharging the pressurized fuel to the common rail 1, injectors 5 for injecting into respective cylinders of the diesel engine the high pressure fuel supplied via respective high pressure pipes (fuel distribution pipes) 4 from the common rail and ECU (electrical control unit) 6 for controlling the system itself. The common rail 1 and the high pressure pipe 4 constitute a high pressure fuel accumulation device.

Figure 1:
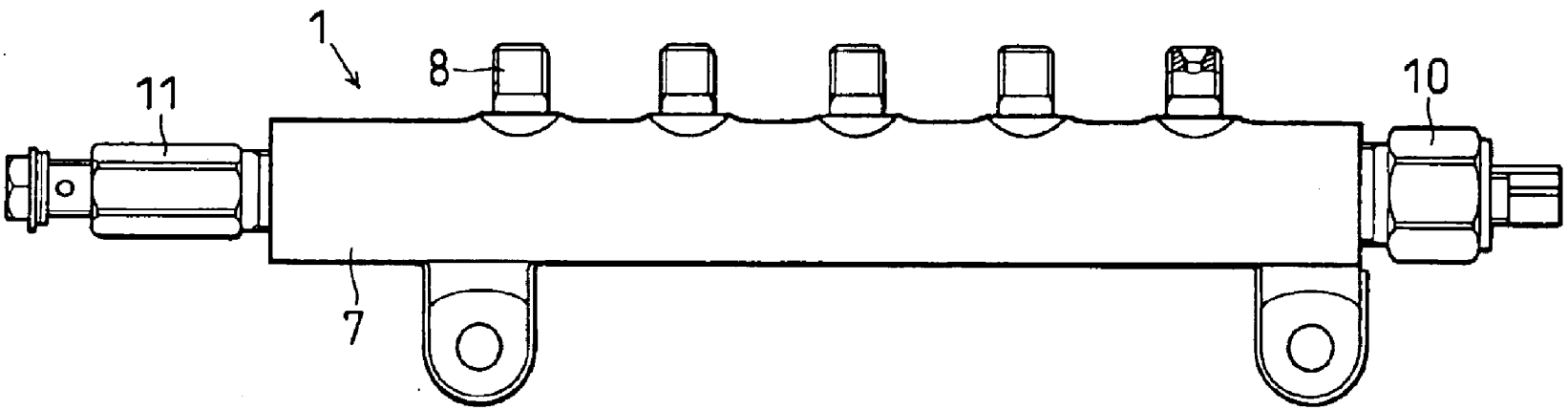
FIG. 1 is a schematic view of an entire structure of a high pressure fuel accumulation device according to a first embodiment of the present invention.
Figure 2:
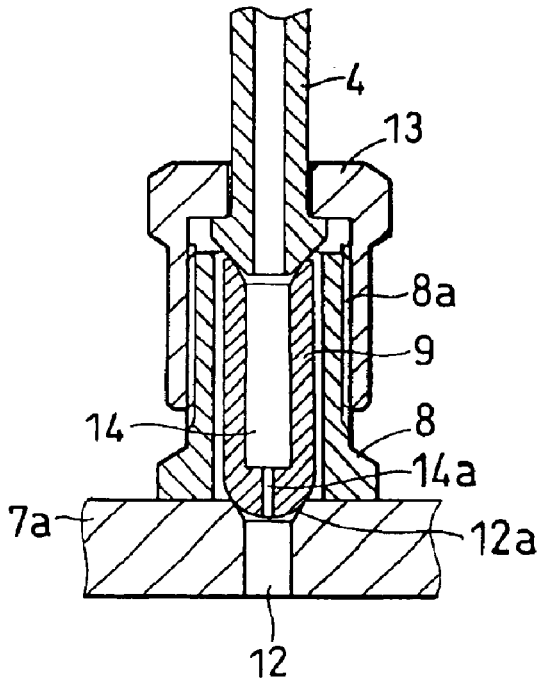
FIG. 2 is a cross sectional view of a main part of the high pressure fuel accumulation device of FIG. 1.

As shown in FIG. 2, the common rail 1 is composed of an accumulation pipe (main body) 7 in which the high pressure fuel is accumulated, pipe joints 8 to each of which each of the high pressure pipes 4 is fastened or connected, orifice members 9 (intermediate members 9) each being housed inside each of the pipe joints 8.

A pressure sensor 10 for detecting pressure of fuel in the common rail 1 and outputting it to ECU 6 and a pressure limiter 11 for controlling not to increase the pressure of fuel in the common rail 1 beyond an upper limit value are mounted in the common rail 1.

The accumulation pipe 7 is provided in an interior thereof with a accumulation chamber (not shown) in which high pressure fuel is accumulated and in a circumference thereof with 5 fuel ports (through-holes) 12 penetrating radially a circumferential wall 7*a* of the accumulation chamber. The fuel ports 12 are composed of 4 pieces of fuel outlets connected to the respective injectors 5 via the respective high pressure pipes 4 and a single piece of a fuel inlet to which the high pressure pump 3 via one of the high pressure pipes 4. The fuel outlets and the fuel inlet are formed in the circumference of the accumulation pipe 7 at a given longitudinal spacing.

A conical seat surface 12*a* is formed in each axial end periphery of the fuel ports 12 on a side of an outer circumference of the circumferential wall 7*a*.

As shown in FIG. 2, each of the pipe joints 8 is formed separately from the accumulation pipe 7 and bonded, for example, by welding, to an outer circumference of the accumulation pipe 7 around each of the fuel ports 12 and at a position substantially concentric with the fuel port 12. The pipe joint 8 is formed in shape of a cylinder whose inner diameter is larger than a maximum outer diameter of the conical seat surface 12*a* and is provided on an outer circumference thereof with a male thread 8*a*. A nut 13, which is preliminarily mounted on the high pressure pipe 4, is screw fastened to the male thread 8*a* so that the high pressure pipe 4 is connected to the pipe joint 8.

Figure 4A:
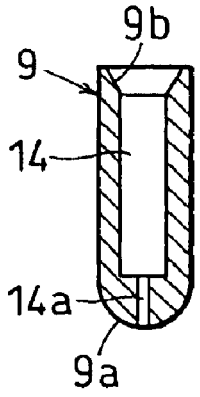
FIG. 4A is a schematic cross sectional view of an orifice provided in the high pressure fuel accumulation device of FIG. 2.

As shown in FIG. 4A, the orifice member 9 is provided with a conduit 14 penetrating through an axis thereof. The conduit 14 is provided at a part of an axial end thereof with an orifice 14*a*, whose inner diameter is smaller than that of the other part thereof. The orifice member 9 is housed inside the pipe joint 8 and sandwiched under pressure between the accumulation pipe 7 and the high pressure pipe 4 fastened to the pipe joint 8 so that the fuel port 12 communicates with the high pressure pipe 4 via the conduit 14.

The orifice 14 is formed in the conduit 14 of the orifice member 6 housed in the pipe joint 8 to which the injector 5 is connected via the high pressure pipe 4. However, it is not always necessary to form the orifice 14 in the conduit 14 of the intermediate member (orifice member) 9 housed in the pipe joint 8 to which the high pressure pump 3 is connected via the high pressure pipe 4.

The orifice member 9 is provided at an axial end thereof with a seat 9*a* which is formed in shape of a semi-sphere. The orifice member 9 is further provided at another axial end thereof with a conical seat surface 9*b* formed along another axial end circumferential periphery of the conduit 14 (refer to FIG. 4A). The seat 9*a* is pressed against and comes in fluid-tight contact with the seat surface 12*a* of the accumulation pipe 7 by fastening force (thrusting force) of the nut 13 on fastening the high pressure pipe 4 to the pipe joint 8 so that a clearance between the seat 6*a* and the seat surface 12*a* is sealed. Further, the thrusting force urges a seat portion of the high pressure pipe 4 to the seat surface 9*b* so that a clearance between the seat surface 9*b* and the seat portion of the high pressure pipe 4 is sealed.

An operation and an advantage of the first embodiment is described.

In the common rail 1 according to the first embodiment, since the orifice 14*a* formed in the conduit 14 through which the high pressure pipe 4 communicates with the fuel port 12 of the accumulation pipe 7 serves to reduce pressure pulsation generated by fuel injection of any one of the injectors 5, fuel pressure in the common rail 1 is stable without being influenced by the pressure pulsation so that fluctuation of injection amount and injection timing of the other injectors 5 is limited.

Since the 14*a* is not formed directly in the accumulation pipe 7 but formed in the orifice member 9 housed inside the pipe joint 8, fabrication of the orifice 14*a* is easier, compared to that of the orifice to be formed in the accumulation pipe. In particular, according to the first embodiment, it is not necessary to form the orifice 14*a* over an entire length of the conduit 14 and the orifice 14*a* is manufactured from an axial end of the orifice member 9 (on a side of the seat 9*a*) so that orifice 14*a* is easily and accurately manufactured.

Figure 4B:
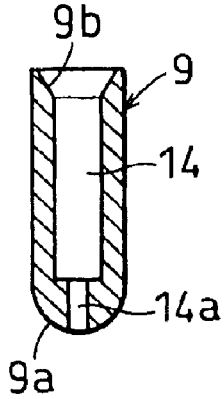
FIG. 4B is a schematic cross sectional view of a modification of the orifice of FIG. 4A.

Further, as shown in FIG. 4B, the common rail 1 having a different inner diameter of the orifice 14*a* can be easily manufactured by changing the inner diameter of the orifice 14*a* formed in the orifice member 9, not in the accumulation pipe 7. That is, in case of changing the inner diameter of the orifice 14*a*, it is not necessary to change fabrication processes of the accumulation pipe 7 itself but necessary to change the orifice member 9 to another orifice member 9 whose inner diameter of the orifice 14*a* is different.

Furthermore, according to the first embodiment, since the pipe joint 8 is formed separately from the accumulation pipe 7, fabrication of the accumulation pipe 7 is easier and, even if an installation position of the pipe joint 8 is different in every engine, fabrication of the accumulation pipe 7 and the pipe joint 8 can be standardized, resulting in less manufacturing cost.

Figure 5:
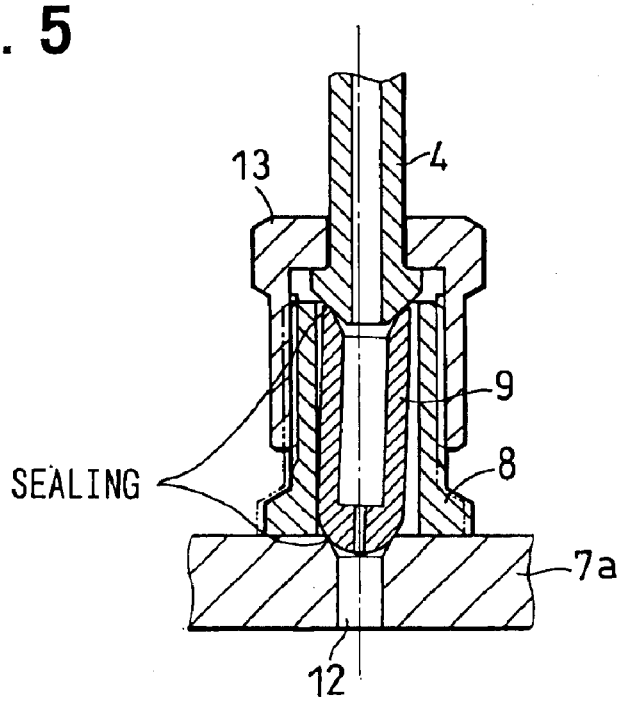
FIG. 5 is another schematic cross sectional view of the main part of the high pressure fuel accumulation device of FIG. 2.

Moreover, the orifice member 9 has the semi-sphere shaped seat 9*a* in contact with the seat surface 12*a* of the fuel port 12 so that a clearance between the seat surface 12*a* and the seat 9*a* can be fluid-tightly sealed. As shown in FIG. 5, even if an axis of the orifice member 9 is shifted from or inclined to an axis of the fuel port 12, when the orifice member 9 is inserted into an interior of the pipe joint 8, shift position or inclination of the orifice member 9 is adjusted when the high pressure pipe 4 is connected to the pipe joint 8 by screw fastening the nut 13 to the male thread 8*a* of the pipe joint 8, since the seat 9*a* of the orifice member 9 is formed in shape of a semi-sphere. As a result, the seat 9*a* of the orifice member 9 comes in fluid-tight contact with an entire circumference of the seat surface 12*a*, which causes confident sealing.

Further, according to the first embodiment, since the pipe joint 8 is formed separately from the accumulation pipe 7, the pipe joint 8 may be bonded to the accumulation pipe 7 in a state that an axis of the pipe joint 8 is slightly shifted from an axis of the fuel port 12. Accordingly, the axis of the orifice member 9 is sometimes off set from or inclined to the axis the fuel port 12, when the orifice member is inserted to the interior of the pipe joint 9, so that an advantage of the semi-sphere shape of the seat 9*a* of the orifice member 9 is larger in the first embodiment in which the pipe joint 8 is separately formed from and, then, bonded to the accumulation pipe 7.

(Second Embodiment)

Figure 6:
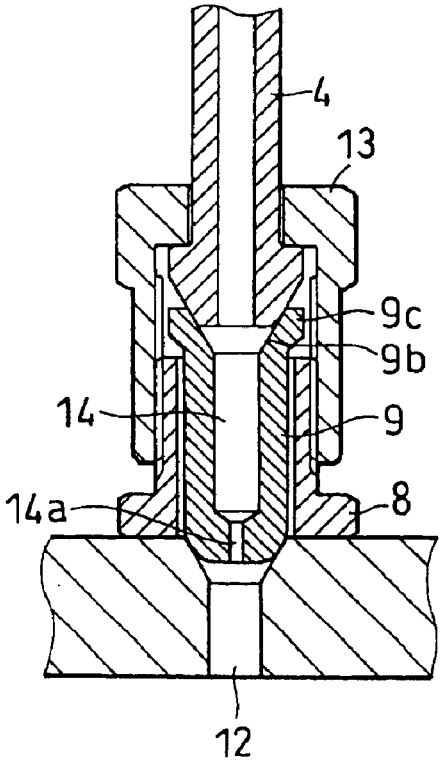
FIG. 6 is a schematic cross sectional view of a main part of the high pressure fuel accumulation device according to a second embodiment of the present invention.

In a high pressure fuel accumulation device according to a second embodiment, the seat surface 9*b* of the orifice member 9 is positioned above an axial upper end of the pipe joint 8, as shown in FIG. 6.

Even if thread diameter of the pipe joint is relatively short so that an outer diameter of the orifice member is small, it is necessary to have the seat surface 9*b* of the orifice member 9 whose area is sufficiently large to be opposed to the seat portion of the high pressure pipe 4*a*. To this end, an axial end of the orifice member 9 on a side opposite to the orifice 14*a* is positioned above the axial upper end of the pipe joint 8 and has a flange 9*c* in which the seat surface 9*b* is formed.

With this structure, even if the thread diameter of the pipe joint 8 is smaller than that of the first embodiment, the orifice member 9 has the seat surface 9*b* sufficiently large to secure reliable sealing.

(Third Embodiment)

Figure 7:
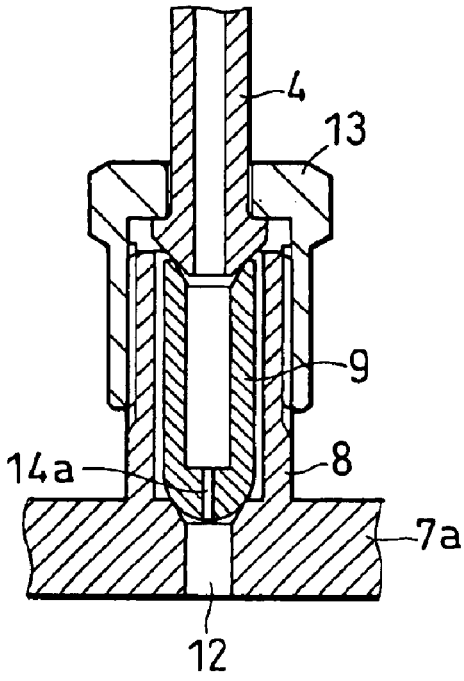
FIG. 7 is a schematic cross sectional view of a main part of the high pressure fuel accumulation device according to a third embodiment of the present invention.
Figure 8:
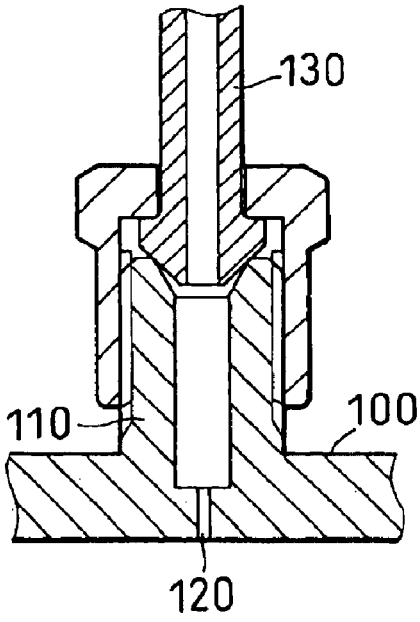
FIG. 8 PRIOR ART
FIG. 8 is a schematic cross sectional view of a main part of a conventional high pressure fuel accumulation device as a prior art.

In a high pressure fuel accumulation device according to a third embodiment, the pipe joint 8 is formed integrally with the accumulation pipe 7 into a single piece, as shown in FIG. 7. The third embodiment, in which the orifice 14 is formed in the orifice member 9 inserted into the interior of the pipe joint 8, has the same advantage as the first embodiment. However, the third embodiment is inferior to the first embodiment in fabrication standardization of the common rail 1, since the pipe joint 8 is formed integrally with the accumulation pipe 7.

What is claimed is:

1. A high pressure fuel accumulation device comprising:

a fuel distribution pipe;

a main body whose interior constitutes an accumulation chamber for accumulating high pressure fuel, the main body being provided in a circumferential wall thereof with a through-hole radially extending from the accumulation chamber and, further, on an exterior circumferential wall thereof surrounding the through-hole and at a position substantially concentric with the through-hole with a hollowed pipe joint to which the fuel distribution pipe is fastened; and a cylindrical intermediate member having a conduit extending through an axial center thereof, the conduit being provided at a part thereof with an orifice whose inner diameter is smaller than that of any other part of the conduit and smaller than an inner diameter of the through-hole, wherein the cylindrical intermediate member is housed inside the hollowed pipe joint and sandwiched under pressure between an axial end of the fuel distribution pipe and the exterior circumferential wall of the main body around the through-hole so that the fuel distribution pipe communicates with the through-hole via the conduit.

2. The high pressure fuel accumulation device according to claim 1, wherein the accumulation chamber is formed inside an accumulation pipe and the through-hole is formed in a circumferential wall of the accumulation pipe and, further, the hollowed pipe joint is formed separately from the accumulation pipe and bonded to an outer circumference of the accumulation pipe.

3. The high pressure fuel accumulation device according to claim 1, wherein the circumferential wall of the main body is provided along an axial end circumference of the through-hole on a side opposite to the accumulation chamber with a conical seat surface, and the cylindrical intermediate member is provided at an end thereof on a side of an axial end of the conduit with a semi-sphere shaped seat, whereby the semi-sphere shaped seat is pressed against the conical seat surface.

4. The high pressure fuel accumulation device according to claim 1, wherein the orifice is formed at an axial end of the conduit so that inner diameter of the conduit extending from the orifice toward the other axial end thereof is larger than that of the orifice.

5. The high pressure fuel accumulation device according to claim 1, wherein the main body has plural pieces of the through-holes formed in the circumferential wall thereof at a given longitudinal spacing, each of the through-holes serving as a fuel outlet of the main body to be connected with each injector via the fuel delivery pipe.

* * * * *